US005951241A

United States Patent [19]

Dahlheimer

[11] Patent Number: 5,951,241

[45] Date of Patent: Sep. 14, 1999

[54] REGENERATIVE TURBINE PUMP COVER

[75] Inventor: John C. Dahlheimer, Laconia, N.H.

[73] Assignee: Freudenberg-NOK General Partnership

[21] Appl. No.: 08/956,525

[22] Filed: Oct. 23, 1997

[51] Int. Cl.[6] ..... F04D 5/00

[52] U.S. Cl. ..... 415/55.4; 415/214.1; 415/215.1

[58] Field of Search ..... 415/55.1, 55.2, 415/55.3, 55.4, 214.1, 215.1, 182.1

[56] References Cited

U.S. PATENT DOCUMENTS

| | | | |
|---|---|---|---|
| 3,257,955 | 6/1966 | Worst | 415/55.4 |
| 3,374,744 | 3/1968 | Toma | 415/55.1 |
| 4,992,690 | 2/1991 | Baker . | |
| 5,078,575 | 1/1992 | Haas et al. . | |
| 5,118,254 | 6/1992 | Ellingson et al. | 415/213.1 |
| 5,232,350 | 8/1993 | Richardson . | |
| 5,273,394 | 12/1993 | Samuel | 415/55.4 |
| 5,476,374 | 12/1995 | Langreck . | |
| 5,498,124 | 3/1996 | Ito et al. . | |

FOREIGN PATENT DOCUMENTS

| | | | |
|---|---|---|---|
| 55-173215 | 6/1982 | Japan | 415/55.1 |

*Primary Examiner*—F. Daniel Lopez
*Assistant Examiner*—Richard Woo
*Attorney, Agent, or Firm*—Dinnin & Dunn, P.C.

[57] ABSTRACT

A regenerative turbine pump cover including an essentially flat bottom surface which includes a plurality of corner post projections. The post projections are located near comers of the cover. The bottom of the cover includes a central cutwater member having fillets extending from the sides and a raised circular projection radius extending from the top of the cutwater. The top of the cover includes well receptacles.

21 Claims, 4 Drawing Sheets

FIG. 4.
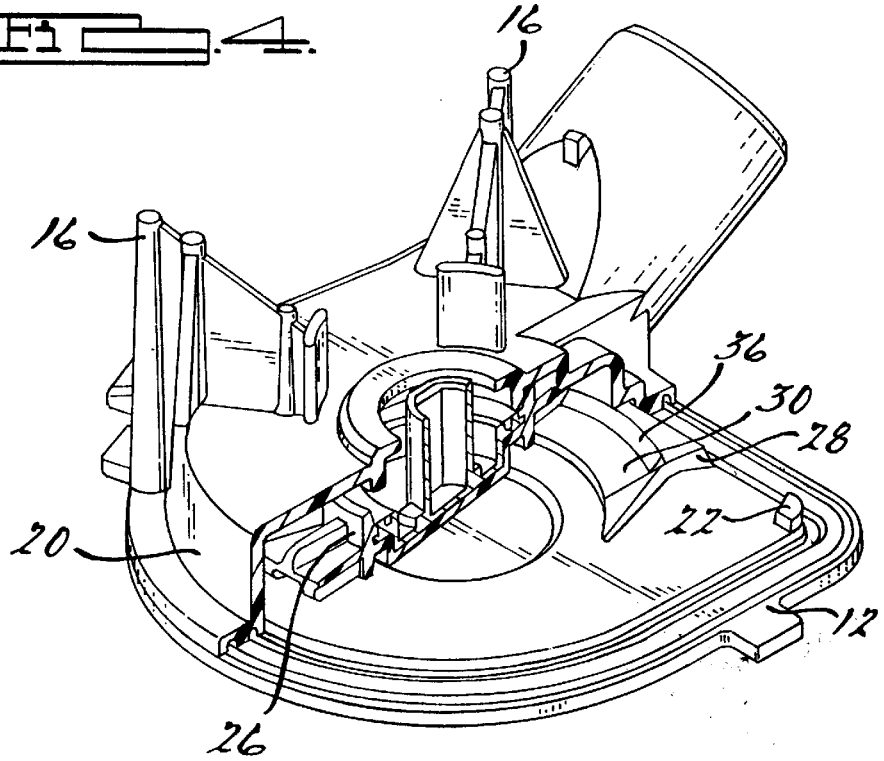
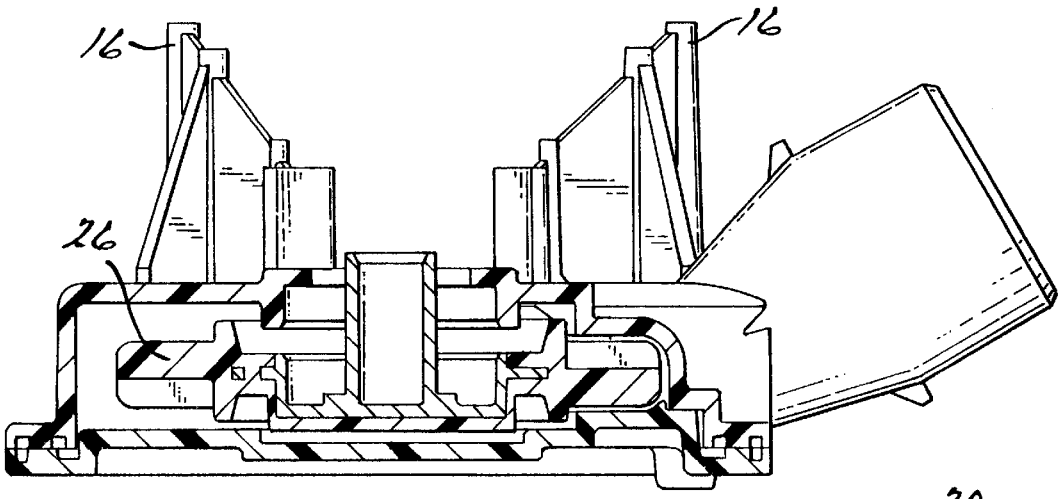
FIG. 5.
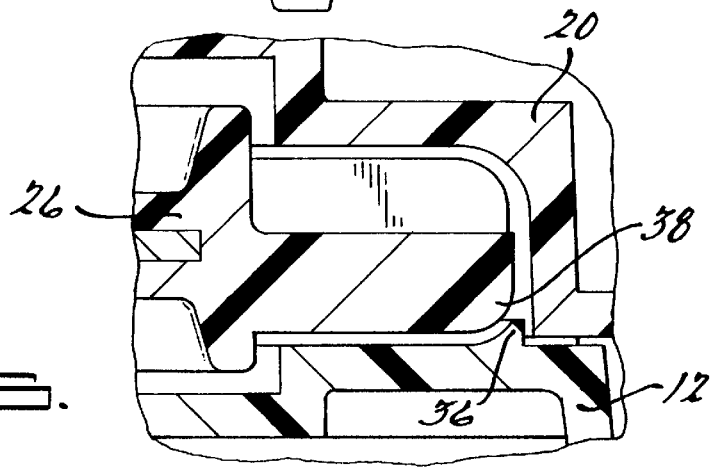
FIG. 6.

REGENERATIVE TURBINE PUMP COVER

BACKGROUND OF THE INVENTION

1. Field of the Invention

The present invention relates to pumps, and more particularly to regenerative turbine pump covers.

2. Description of Related Art

Many of today's home appliances such as dishwashers and washing machines include a pump. The pump is used to move a liquid throughout the appliance system. The pump generally includes a pump cover and a pump housing. The pump housing includes an inlet tube and an outlet tube which connect the pump to the appliance and allow the flow of liquid throughout the appliance itself.

Many of these prior art pumps have squared corner impeller blades in order to keep pump efficiency high by reducing the amount of clearance between the impeller blades and the cutwater area of the pump cover and pump housing located between the pump inlet and outlet. However, while having squared comers on the impeller blades will increase efficiency it also tends to snag onto and not release items such as strings or socks which are drawn into the pump from the dishwasher and/or clothes washer. The prior art pumps also tend to include flat faced walls in the corners of the pump which are adjacent to and perpendicular to the inlet and outlet of the pump housing. These flat surfaces create abrupt transitions in the flow of the liquid being pumped causing noise and reduced pumping efficiency and also provide surfaces and inside corners against which objects such as toothpicks and hairpins can jam between the pump housing and impeller stopping impeller rotation. The prior art pumps also created a shipping problem by having to create separate packing material in order to stack the pumps in a container such that the pumps will not move around the container thus damaging the shipment to an appliance machine or other type of manufacturer. They also do not lend themselves to being stacked on one another in a secure and oriented manner to reduce horizontal work cell space and to facilitate handling by robotic equipment.

Therefore, there is a need in the art for a pump that reduces the occurrence of articles becoming snagged or caught within the pump such as strings, socks, hairpins, etc. and there is also a need in the art to increase efficiency while reducing the noise the pump impeller makes while pumping the liquid through the pump housing inlets and outlets. There is also a need in the art for a pump that will allow easy storage and handling of the pump units in bulk from the maker to the manufacturer of the appliances. Furthermore, there is a need for a pump that will allow for easy stacking of pumps in shipping containers to protect them in transit and to allow them to be stacked in a secure and oriented manner in work cells at the appliance manufacturer to save space and facilitate automated handling.

SUMMARY OF THE INVENTION

One object of the present invention is to provide an improved regenerative turbine pump cover.

Another object of the present invention is to provide an economical way to ship and handle stacked pumps.

Yet another object of the present invention is to provide a pump which creates less turbulence in the liquid flowing in and out of the pump thus increasing efficiency and quieting pump operation.

Yet another object of the present invention is to eliminate any jam or snag points which will otherwise catch foreign objects and prevent their discharge from the pump.

Another object of the present invention is to provide close clearance with radiused impeller blade comers to the pump cutwater thus increasing pumping efficiency.

To achieve the foregoing objects the regenerative turbine pump cover includes an essentially flat bottom surface which includes a plurality of corner post projections. The post projections are located near comers of the cover. The bottom of the cover also includes a raised central cutwater member having fillets extending from the sides of the cutwater member and a raised circular projection radius extending from the top of the cutwater member. The top essentially flat surface of the cover includes well receptacles near an edge of the cover.

One advantage of the present invention is that it creates economical shipping and easier handling of stacked pumps.

A further advantage of the present invention is that it provides for greater efficiency and quieter operation with less turbulence by the liquid flowing in and out of the pump.

Still a further advantage of the present invention is that it eliminates the jam and snag points which catch foreign objects and prevent their discharge from the pump unit.

A further advantage of the present invention is that the close clearance with the radiused impeller blade comers to the pump cut water area increases pumping efficiency.

Other objects, features and advantages of the present invention will become apparent from the subsequent description and appended claims, taken in conjunction with the accompanying drawings.

BRIEF DESCRIPTION OF THE DRAWINGS

FIG. 4 shows a cut away of the assembled pump housing and pump cover.

FIG. 5 shows a cross section of the assembled pump housing and pump cover.

FIG. 6 shows an enlarged view of the radiused corners of the impeller blades.

Figure 1:
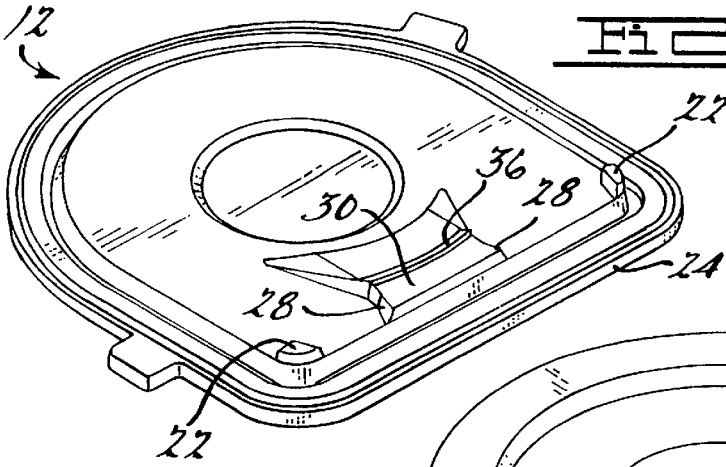
FIG. 1 shows a bottom view of the present invention.
Figure 2:
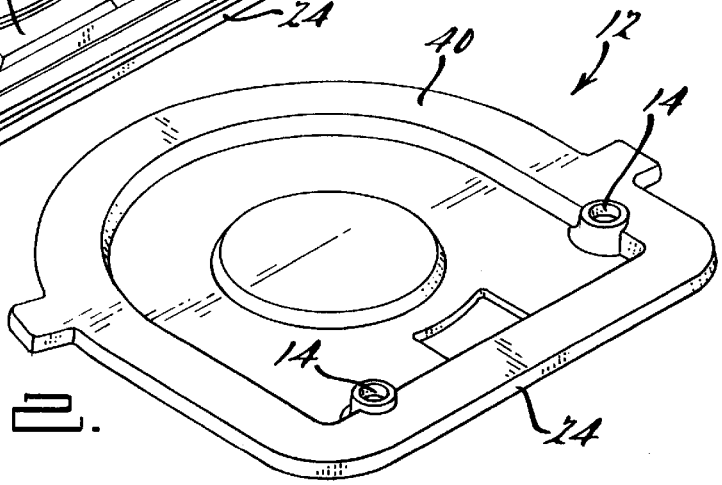
FIG. 2 shows a top view of the present invention.
Figure 3:
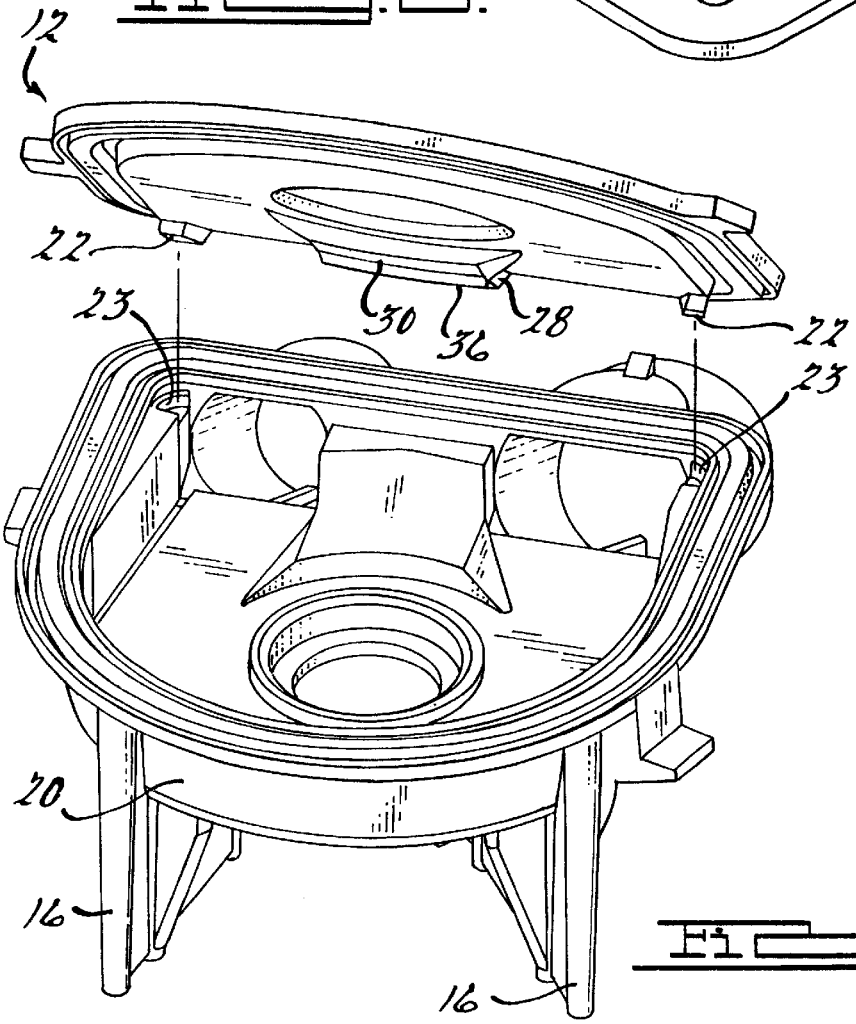
FIG. 3 shows the pump cover in relation to the pump housing just before assembly.
Figure 7:
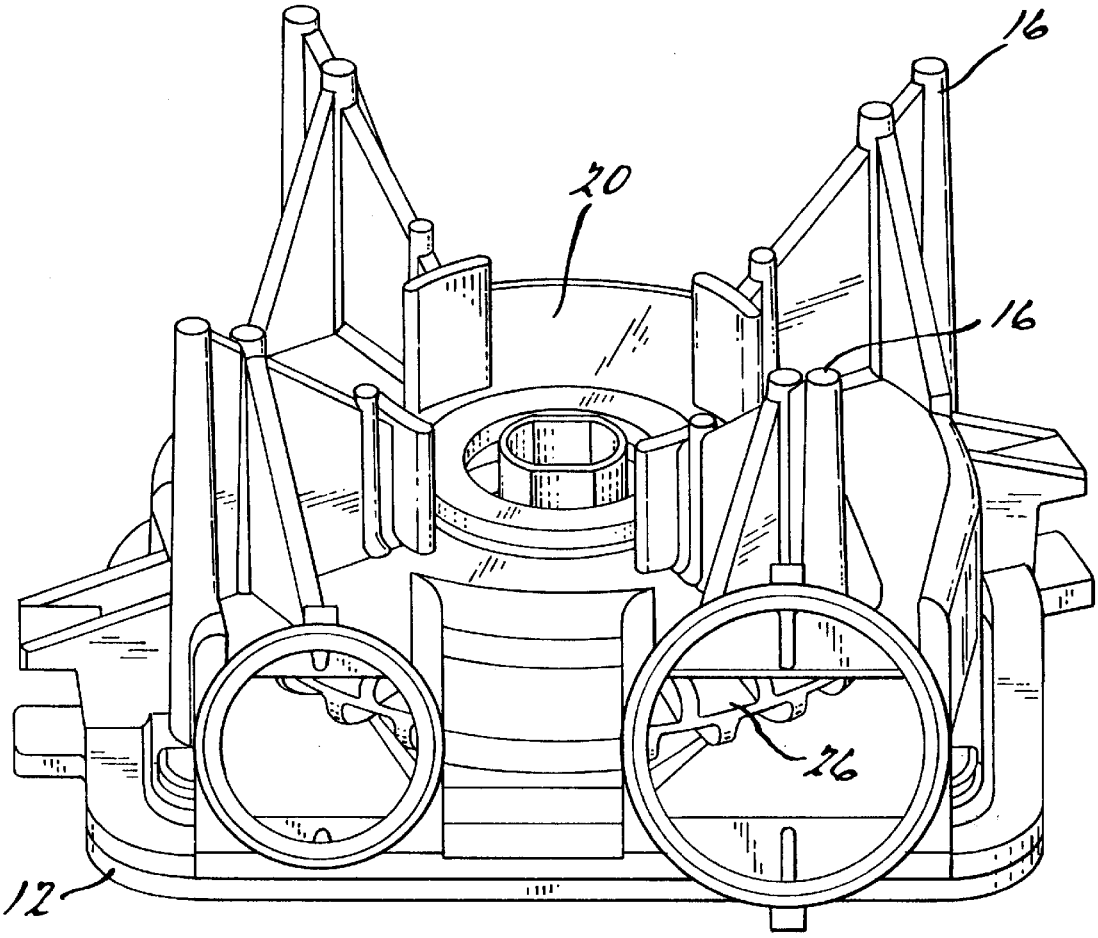
FIG. 7 shows a view into the pump housing through the inlet and outlet.
Figure 8:
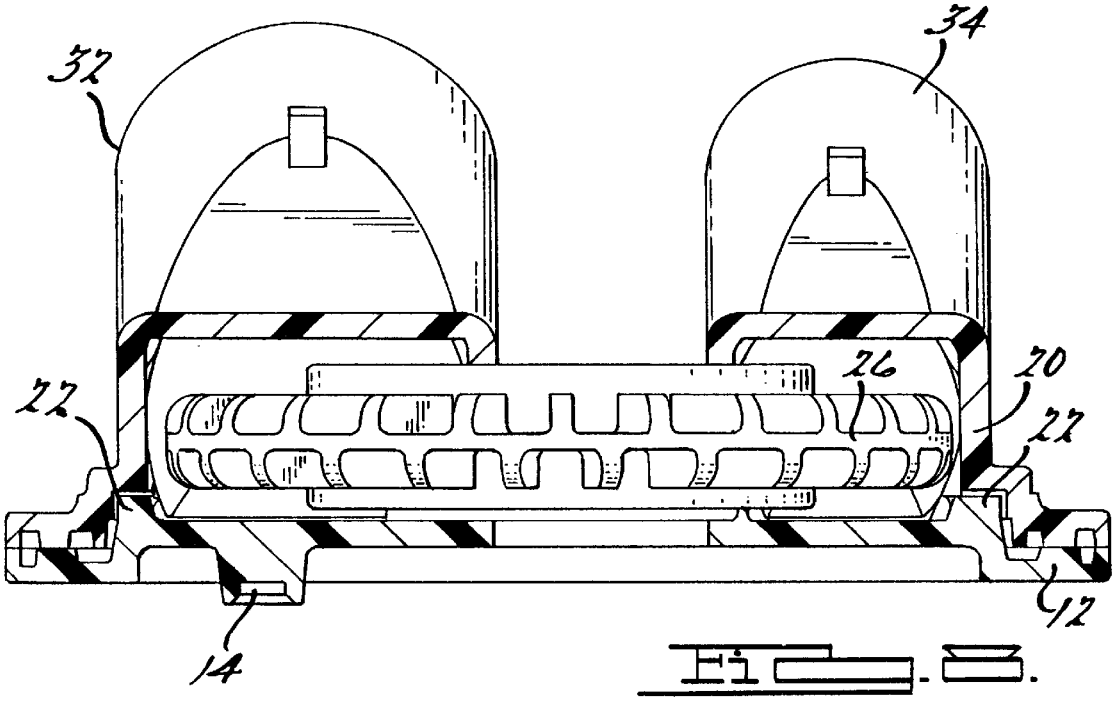
FIG. 8 shows a partially cut away side view of the present invention.
Figure 9:
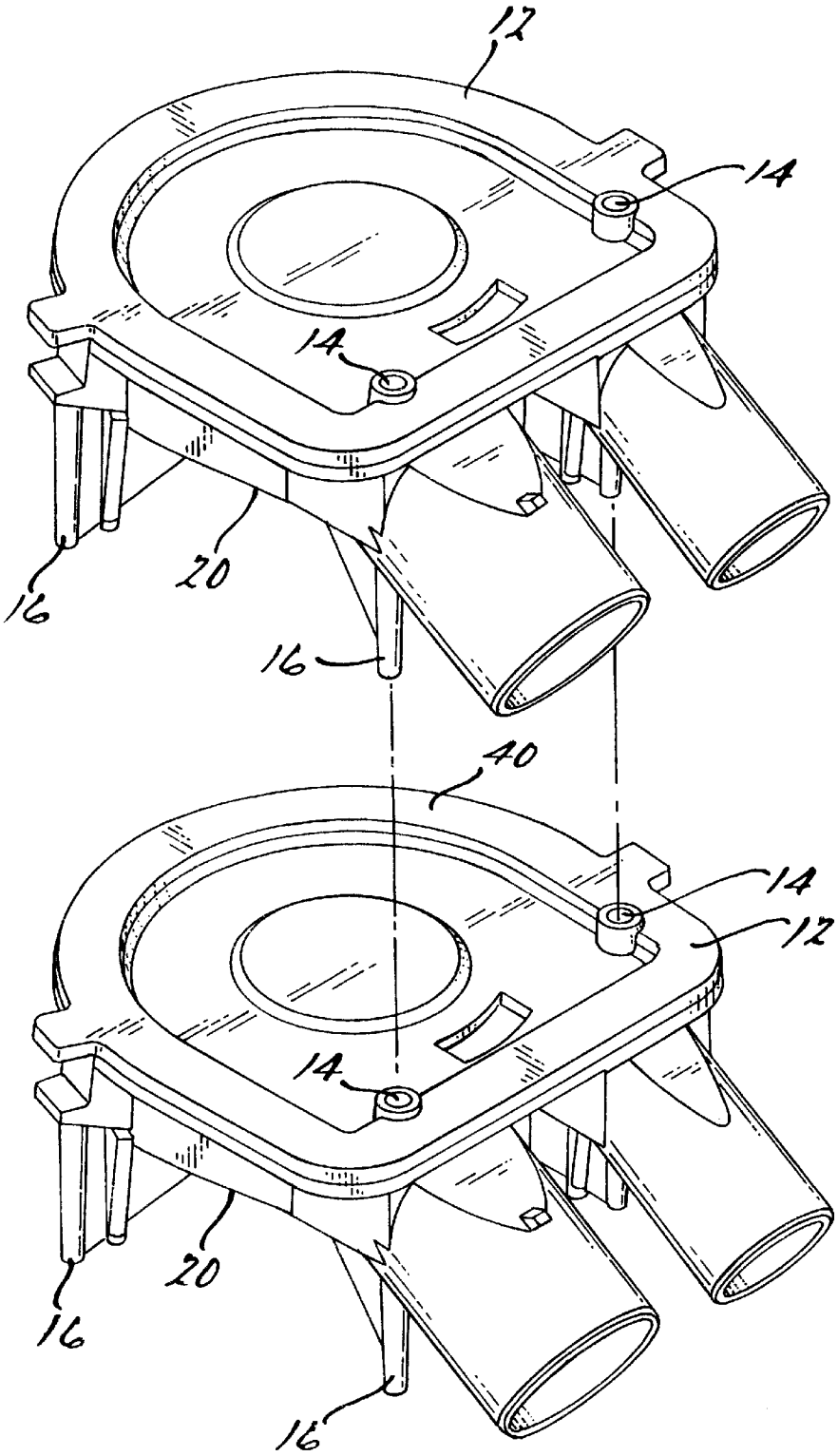
FIG. 9 shows the stacking arrangement of assembled pumps utilizing the present pump cover invention.

BEST MODE OF CARRYING OUT THE INVENTION AND DESCRIPTION OF THE PREFERRED EMBODIMENT(S)

Referring to the drawings, an improved regenerative turbine pump cover 12 is shown. The pump cover 12 is essentially flat and includes molded-in well receptacles 14 on its top surface which are used to receive the legs 16 of another pump stacked on top of it for shipping. The molded-in well receptacles 14 are also used to prevent shifting of the pumps with relation to one another in the container used for such shipping or when stacked at a work station to conserve space or facilitate handling. The pump cover 12 has a generally D-shaped appearance from its top view. The preferred embodiment has two molded-in well receptacles 14 both located near the flat edge or side 24 of the pump cover 12. However, it should be noted that the well receptacles 14 may be placed in other positions on the top of the pump cover 12 depending on the shape of the pumps and the area available to place the legs 16 in the pump housing 20. It should also be noted that more than two well receptacles 14 maybe molded into the pump cover 12 depending on the needs of the pump and the shipping container. The pumps stack using legs 16 and mating well receptacles 14 thus reducing manufacturing costs by needing less space and also facilitating shipping and handling of the pumps without intervening layers of packaging trays or other packaging material which are an added expense and create a disposal problem for the appliance manufacturers.

The bottom of the improved regenerative turbine pump cover 12 is also an essentially flat surface. The bottom surface of the cover 12 includes post-like corner fillets or projections 22 which are located near the comers of the cover 12 nearest the flat edge 24 of the cover 12. The post-like corner fillets 22 mate with a similarly shaped recess 23 in a pump housing 20. The corner fillet or projection 22 generally has the shape of a quarter of a circle. These corner fillets 22 eliminate any flat face comers adjacent to the inlet 32 and outlet 34 of the pump housing 20 which would otherwise create catch and jam surfaces for foreign objects passing through the pump which in turn would prevent their discharge or even stop the rotation of the impeller 26. The bottom portion of the pump cover 12 also includes fillets or projections 28 that project and extend from the sides of the raised central cut water 30. These projections and fillets 28 will also smooth the transition from the truncated elipitical shaped inlet 32 and outlet 34 ports which open into the flat molded passageways of the pump body. The fillets and projections 28 streamline the flow of liquid flowing in and out of the pump eliminating turbulence which creates a greater efficiency, quieter operation and it eliminates flat faced corners which have the opportunity to snag or jam objects passing through the pump. The fillets 28 have to be placed on each side of the raised central cut water 30 because a regenerative turbine pump reverses direction to recirculate rather than empty out wash water such that the inlet 32 sometimes acts as the outlet 34 and vice versa.

The pump cover 12 also includes on its bottom portion a raised radiused circular projection 36 which is molded from the central cut water 30 of the pump cover 12 to fill in the corner gap that would otherwise exist when using radiused impeller blades 38. The radiused circular projection 36 is designed to create minimal clearance with radius comers of an impeller blade 38. The corner gap being removed increases pumping efficiency by discharging liquid out of the pump rather than recirculating liquid through the gap and pump interior. The use of radiused rather than sharp cornered impeller blades 38 eliminates many of the snag points on the impeller which would hold onto and prevent release of foreign objects drawn into the pump thus causing it to stall or not restart.

The improved pump cover 12 is used in conjunction with a pump housing 20 that includes a plurality of leg members 16 which are used to mate with the well receptacles 14 on the top of the pump cover 12 such that the pump units maybe stacked and handled with more ease. The interconnection of the legs 16 and receptacles 14 prevents toppling of the stacked pump units and keeps them aligned to one another. When stacking the pumps the well-like receptacles hold two legs 14 and prevents their shifting and further orients other legs 14 to be located on a flat curved flange portion 40 on the top part of the pump cover 12. The pump cover 12 is vibration or heat plate welded to the pump housing 20, the essentially flat surfaces of the pump cover 12 facilitating this welding. The pump housing 20 includes a tubular-like inlet 32 and outlet 34 around which rubber hoses are clamped. An impeller 26 fits within the pump housing 20 and is covered over by the cover 12. The pump is then connected to an electric motor housing having well like receptacles similar to those provided in the improved pump cover 12 to complete the pump and motor assembly.

The present invention has been described in an illustrative manner, it to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A regenerative turbine pump cover, said pump cover including:

an essentially flat surface which includes a plurality of corner post projections, said post projections located near a corner of said cover, said cover having a raised central cutwater member, said raised cut water member having a fillet extending from a side thereof.

2. The cover of claim 1 wherein said fillet streamlines a flow of a liquid into and out of a pump and eliminate jam points for foreign objects passing through the pump.

3. The cover of claim 1 wherein said post projections extend beyond a bottom side of said cover.

4. The cover of claim 3 wherein said post projections mate with a pump housing.

5. The cover of claim 4 wherein said post projections streamline a flow of liquid into and out of a pump and eliminate jam points for foreign objects passing through the pump.

6. The cover of claim 1 further including a radiused circular projection attached to said raised central cut water member.

7. The cover of claim 6 wherein said circular projection is attached by molding to said central cut water member.

8. The cover of claim 1 further including a plurality of receptacles in said cover.

9. The cover of claim 8 wherein said receptacles are located on a top side of said cover.

10. The cover of claim 9 further including a pump housing, said pump housing including a plurality of legs, said legs mate with said receptacles in said pump cover.

11. The cover of claim 10 wherein mating prevents shifting of stacked pumps and orients them with respect to one another.

12. The cover of claim 6 wherein said circular projection profile matches a radiused impeller blade profile.

13. The cover of claim 12 wherein said matching profiles provide for greater pump efficiency by encouraging discharge rather than recirculation of a fluid being pumped.

14. A regenerative turbine pump cover, said pump cover including:

a generally flat surface having a top and bottom, said top surface including a plurality of well receptacles, said bottom surface including a plurality of corner post projections, said bottom surface including a raised central cut water member, said cut water member having fillets extending from sides thereof.

15. The cover of claim 14 wherein said well receptacles align with and mate with legs on a pump housing.

16. The cover of claim 14 further including a radiused circular projection extending from said cut water.

17. A regenerative turbine pump, said pump including:

a pump housing including a plurality of legs extending from an outer surface;

a pump cover secured to said pump housing, said pump cover having a generally flat top and bottom surface, said top surface having a plurality of well receptacles, said bottom surface including a plurality of corner post projections, said bottom surface having a raised central cut water member, said cut water member having a fillet extending from a side of said cut water, said central cut water member having a radiused circular projection.

18. The regenerative turbine pump of claim 17 wherein said radiused circular projection matches a contour of a radiused impeller blade.

19. The regenerative turbine pump of claim 17 wherein said legs of a first pump align with and mate with said well receptacles of a second pump.

20. The regenerative turbine pump of claim 17 wherein said corner post projections, said fillets and said radiused circular projection are molded in said pump cover.

21. The regenerative turbine pump of claim 17 wherein said corner projections and said fillets streamline a flow of liquid in and out of said pump and eliminate snag and catch points in said pump.

* * * * *

UNITED STATES PATENT AND TRADEMARK OFFICE

CERTIFICATE OF CORRECTION

PATENT NO. : 5,951,241
DATED : September 14, 1999
INVENTOR(S) : Dahlheimer

It is certified that error appears in the above-identified patent and that said Letters Patent is hereby corrected as shown below:

Column 1,
Line 21, please delete “comers” and insert -- corners --

Column 2,
Line 2, please delete “comers” and insert -- corners --
Line 7, please delete “comers” and insert -- corners --
Line 24, please delete “comers” and insert -- corners --

Column 3,
Line 15, please delete “comers” and insert -- corners --
Line 20, please delete “comers” and insert -- corners --
Line 45, please delete “comers” and insert -- corners --

Signed and Sealed this

Twenty-eighth Day of January, 2003

JAMES E. ROGAN
*Director of the United States Patent and Trademark Office*